US007880341B2

(12) United States Patent
Shin

(10) Patent No.: US 7,880,341 B2
(45) Date of Patent: Feb. 1, 2011

(54) SWITCHING DEVICE FOR TRANSFORMER HAVING UNINTERRUPTIBLE POWER SUPPLY FUNCTION, AND METHODS OF CONTROLLING TURN RATIO AND VOLTAGE OF THE TRANSFORMER USING THE SAME

(75) Inventor: Dong Yeol Shin, Daejeon (KR)

(73) Assignee: Korea Electric Power Corporation, Seoul (KR)

( * ) Notice: Subject to any disclaimer, the term of this patent is extended or adjusted under 35 U.S.C. 154(b) by 575 days.

(21) Appl. No.: 11/942,538

(22) Filed: Nov. 19, 2007

(65) Prior Publication Data

US 2009/0026845 A1 Jan. 29, 2009

(30) Foreign Application Priority Data

Jul. 25, 2007 (KR) ..... 10-2007-0074747

(51) Int. Cl.
*H01H 35/00* (2006.01)
*H01H 47/00* (2006.01)

(52) U.S. Cl. ..... 307/130

(58) Field of Classification Search ..... 307/130
See application file for complete search history.

(56) References Cited

U.S. PATENT DOCUMENTS 5,726,561 A * 3/1998 Ghosh et al. ..... 323/255

* cited by examiner

*Primary Examiner*—Jared J Fureman
*Assistant Examiner*—Dru M Parries
(74) *Attorney, Agent, or Firm*—Kenyon & Kenyon LLP

(57) ABSTRACT

A switching device for a transformer allows stable power supply without power interruption when a secondary winding voltage of the transformer is changed in the case of voltage drop on a distribution line due to a load characteristic. The switching device having an uninterruptible power supply function includes a plurality of switches operated by an external signal, a current circulation unit for multiple switches electrically connected to a large-current path of the switches to perform a switch-on function in place of the switches upon switching on and off between the switches, and a control unit electrically connected to the switches and current circulation unit to read voltage values and to apply signals to the switches depending on the voltage values to sequentially switch the switches. Accordingly, the switching device can stably supply power to power consumption sources without power interruption.

9 Claims, 17 Drawing Sheets

| Contact points | 13800V (43) | 13200V (42) | 12600V (41) | Ground (60) |
|---|---|---|---|---|
| 1–2 | 1 | 0 | 0 | 1 |
| 2–3 | 1 | 1 | 0 | 0 |
| 3–4 | 0 | 1 | 0 | 1 |
| 4–5 | 0 | 1 | 1 | 0 |
| 5–6 | 0 | 0 | 1 | 1 |

FIG.3h

SWITCHING DEVICE FOR TRANSFORMER HAVING UNINTERRUPTIBLE POWER SUPPLY FUNCTION, AND METHODS OF CONTROLLING TURN RATIO AND VOLTAGE OF THE TRANSFORMER USING THE SAME

CROSS-REFERENCE TO RELATED APPLICATIONS

The present application claims priority to Application No. 10-2007-0074747, filed in the Republic of Korea on Jul. 25, 2007, which is expressly incorporated herein in its entirety by reference thereto.

FIELD OF THE INVENTION

The present invention relates to a transformer, and more particularly to a switching device for a transformer having an uninterruptible power supply function and methods of controlling a turn ratio and voltage of the transformer using the same.

BACKGROUND INFORMATION

Transformation may take place in several stages in sequence, starting at a power station where voltage is increased to extra high voltage, such as 765 kV, 345 kV or 154 kV, for transmission purposes and is then progressively reduced to the voltage required for household or industrial use. That is, at a transformer substation, the extra high voltage is transformed to a line voltage of 22,900V, which corresponds to a phase voltage of 13,200V, for use in buildings or plants. The line voltage at the transformer substation may be further reduced to a voltage of 220/380V for household or industrial use by a transformer installed at a pole or a ground.

A transformer for the above-mentioned power supply is generally a one-end grounded auto-transformer which is connected to each of R-, S- and T-phases. The transformer has three taps of 13,800V, 13,200V and 12,600V at its primary winding. At this time, the secondary winding voltage is reduced to 230V and is supplied to a load. The secondary winding voltage is determined by changing the taps of the primary winding.

Power supply from a transformer substation to loads, such as houses or plants, using the transformer is described with reference to FIG. 1*a*. FIG. 1*a* illustrates the operation of transformer in which voltage drop segments are shown on a distribution line.

Referring to FIG. 1*a*, a distribution line 1 is typically 5 to 30 km in length from a transformer substation to a terminal 3 of the distribution line 1. An involved transformer substation 4 is connected to the terminal 3 in preparation for line fault.

Additionally, a connection switch 5 is provided on the distribution line 1 to distribute power, which is switched off at ordinary times and is switched on at a line fault. When the connection switch 5 is switched off, a load rate varies throughout the distribution line 1, resulting in different system voltages. Accordingly, a transformer 7 is set to have a primary winding voltage of 13,200V in a segment 6 with a voltage drop of 0 to 5%, and a transformer 9 is set to have a primary winding voltage of 12,600V in a segment 8 with a voltage drop of 5 to 10%.

However, the distribution line 1, of which voltage is controlled by an Under Load Tap Changer (ULTC) of a main transformer installed at the transformer substation 2, has a varying voltage of 23,816 to 22,670V (a ULTC voltage reference of 22.9 kV with a margin of +4 to −1%), which is drawn out of the transformer substation 2, depending on power service areas and loads at a peak time and at midnight. Therefore, since the voltage of the distribution line 1 having different characteristics in loads needs to be simultaneously adjusted, consumers neighboring the terminal 3 of the distribution line 1 may not be supplied with appropriate voltage.

Additionally, unlike the ULTC of the main transformer installed at the transformer substation 2, the transformers 7 and 9, which are installed at the distribution line 1 and convert the voltage to commercial voltage to distribute power to the consumers, manually change the voltage.

FIG. 1*b* is a partial cross-sectional view of such a conventional transformer which manually changes the voltage. As shown in FIG. 1*b*, the transformer includes a transformer cell 10 consisting of primary and secondary windings wound around an iron core, in which the primary winding is electrically connected to a tap switch 11.

FIG. 1*c* illustrates the transformer cell 10 of which primary and secondary windings 10-1 and 10-2 are electrically connected to the tap switch 11.

Referring to FIG. 1*c*, the tap switch 11 includes of first, second and third taps 11-1, 11-2 and 11-3, which can be connected to the primary winding 10-1 to set 12,600V, 13,200V and 13,800V, respectively. In this case, the voltage of 13,200V is set by manually switching off the first and third taps 11-1 and 11-3 and manually switching on the second tap 11-2 on the distribution line with a voltage drop between 0 and 5%. The voltage of 13,800V is set by manually switching off the first and second taps 11-1 and 11-2 and manually switching on the third tap 11-3 on the distribution line with a voltage drop between 5 and 10%. Likewise, the voltage of 12,600V is set by manually switching off the second and third taps 11-2 and 11-3 and manually switching on the first tap 11-1. Accordingly, the voltage can be adjusted at the secondary winding 10-2 of the transformer by switching on the respective taps 11-1, 11-2 and 11-3.

However, switching the taps may cause power-supply interruption between the transformer and the consumers since only one of the first, second and third taps 11-1, 11-2 and 11-3 is designed to be selected to prevent the transformer from being short-circuited when the first and second taps 11-1 and 11-2 are simultaneously switched on in the primary winding 10-1 having a voltage difference of 600V between the points of 13,800V, 13,200V and 12,600V.

Furthermore, the tap switching involves manual operation of the transformer while a cutout switch (COS) of the primary winding 10-1 is switched off. At this time, foreign matter, such as moisture, dust and rainwater, may come inside the transformer and deteriorate insulation oil contained in the transformer, causing trouble with the transformer.

Additionally, electric current which is reversely supplied from the generator to the secondary winding 10-2 during the tap switching may give operators or workers an electric shock. To prevent the electric shock due to the electric current, the secondary winding 10-2 needs to be grounded and lead wires connected to the secondary winding 10-2 need to be removed, which causes the operators to avoid the tap switching.

Furthermore, dispersed power sources, such as solar power, wind power, and cogeneration power, are increasingly involved with the distribution lines for power supply, leading to a severe fluctuation in voltage. In addition, it is difficult to adjust the tap switches installed at the transformer during power suspension in each voltage drop segment of the distribution line to prepare for seasonal loads or midnight loads of which characteristics are hard to estimate.

SUMMARY

Example embodiments of the present invention address the problems of conventional techniques, such as those described above, and example embodiments of the present invention provide a switching device and methods that can provide reliable voltage supply to a power consumption source at a secondary winding of a transformer in a voltage drop condition caused by a load characteristic of a distribution line.

Example embodiments of the present invention to provide a switching device and methods that can provide automatic voltage adjustment of a secondary winding of a transformer.

Example embodiments of the present invention provide a switching device and methods that can provide a stable power supply from a transformer to consumers without power interruption.

Example embodiments of the present invention provide a method of efficiently operating a transformer simultaneously with accomplishment of the above-mentioned aspects and benefits hereof.

According to example embodiments of the present invention, a switching device having an uninterruptible power supply function includes: a plurality of switches operated by an external signal; a current circulation unit for multiple switches electrically connected to a large-current path of the switches to perform a switch-on function in place of the switches upon switching on and off between the switches; and a control unit electrically connected to the switches and current circulation unit to read voltage values and to apply signals to the switches depending on the voltage values to sequentially switch the switches.

The control unit may include: a detection circuit; an A/D converter to convert voltage measured by the detection circuit into digital signals; a sorting circuit to sort the digital signals by a predetermined range; and a switching control circuit to selectively output signals to the switches depending on the digital signals sorted by the sorting circuit.

The current circulation unit for multiple switches may include: a first bypass part including a first capacitor and a first coil connected in parallel with each other; a second bypass part electrically connected to one point where the first bypass part is connected in parallel with the first coil, and including a second capacitor and a second coil connected in parallel with each other; and an iron core inserted between the first and second coils and wound with the first and second coils.

The switches may include: a path-selection switch which connects a large-current path; a current-circulation switch electrically connected to the large-current path; and a bypass switch electrically connected to the path-selection switch and electrically connected to a ground.

Each of the switches may include an insulated-gate bipolar transistor (IGBT) or a silicon-controlled rectifier (SCR), and be switched on and off by the control unit.

The switches, the current circulation unit for multiple switches, and the control unit may be electrically connected through external connection terminals, and may be enclosed by an insulator with the external connection terminals exposed.

According to example embodiments of the present invention, a switching device includes: a motor driven by a control signal; a plurality of rotary switches sequentially coupled to a rotating shaft of the motor and including a plurality of contact points; a current circulation unit for multiple switches electrically connected to the contact points of the rotary switch to circulate current between the contact points connected by the rotary switch when the contact points of the rotary switch are changed by rotation of the rotary switch; and a control unit electrically connected to the motor to read a voltage value and to change the contact points of the rotary switch by rotating the motor depending on the voltage value.

The current circulation unit for multiple switches may include: a first bypass part including a first capacitor and a first coil connected in parallel with each other; a second bypass part electrically connected to one point where the first bypass part is connected in parallel with the first coil, and including a second capacitor and a second coil connected in parallel with each other; and an iron core inserted between the first and second coils and wound with the first and second coils.

The control unit may include: a detection circuit; an A/D converter to convert voltage measured by the detection circuit into digital signals; a sorting circuit to sort the digital signals by a predetermined range; and a motor drive circuit to output signals for rotating the motor depending on the digital signals sorted by the sorting circuit.

According to example embodiments of the present invention, a method of automatically adjusting a turn ratio of a transformer includes: measuring voltage of the transformer; comparing the voltage to sort the voltage by a predetermined range; and adjusting a turn ratio of the transformer corresponding to the predetermined range.

The adjusting of the turn ratio may include returning to measuring the voltage of the transformer after a predetermined interval, when automatically changing the turn ratio of the transformer.

According to example embodiments of the present invention, a method of adjusting voltage of a transformer to automatically control power by the transformer installed at each segment between a transformer substation and a power consumption source includes: increasing a primary winding voltage by changing a primary winding of the transformer when the primary winding voltage is in a dropped state for a predetermined time; or decreasing a primary winding voltage by changing a primary winding of the transformer when the primary winding voltage is in a raised state for a predetermined time.

The transformer may set the primary winding to a voltage of 13,800V when the primary winding voltage exceeds 13,500V due to a decreased load, and set the primary winding to a voltage of 13,200V when the primary winding voltage exceeds 12,900V due to a decreased load; and set the primary winding to a voltage of 13,200V when the primary winding voltage is 13,200V or less due to an increased load, and set the primary winding to a voltage of 12,600V when the primary winding voltage is 12,600V or less due to an increased load.

The voltage of the transformer may be adjusted without power interruption.

The above and other features and aspects of example embodiments of the present invention are described in more detail below with reference to the appended Figures.

BRIEF DESCRIPTION OF THE DRAWINGS

FIG. 3*h* is a table indicating switching on/off of external connection terminals and a current circulation device for multiple switches when the respective movable contacts of the rotary switches shown in FIGS. 3*c* to 3*g* are connected to a plurality of contact points.

DETAILED DESCRIPTION

Figure 1A:
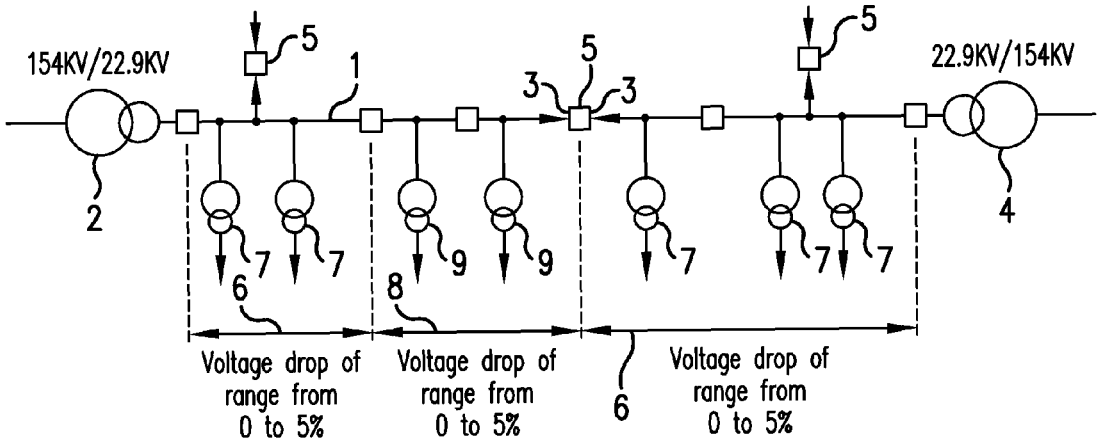
FIG. 1*a* is a schematic view of operation of a transformer with a distribution line with voltage drop segments indicated.
Figure 1B:
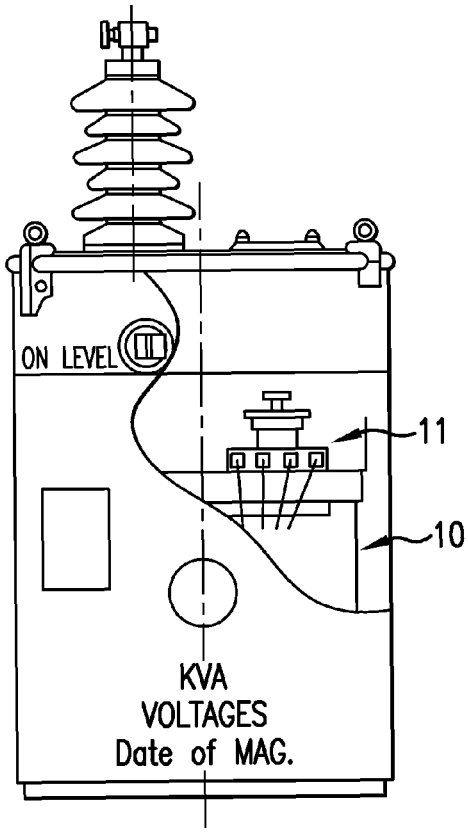
FIG. 1*b* is a partial cross-sectional view of a conventional transformer.
Figure 1C:
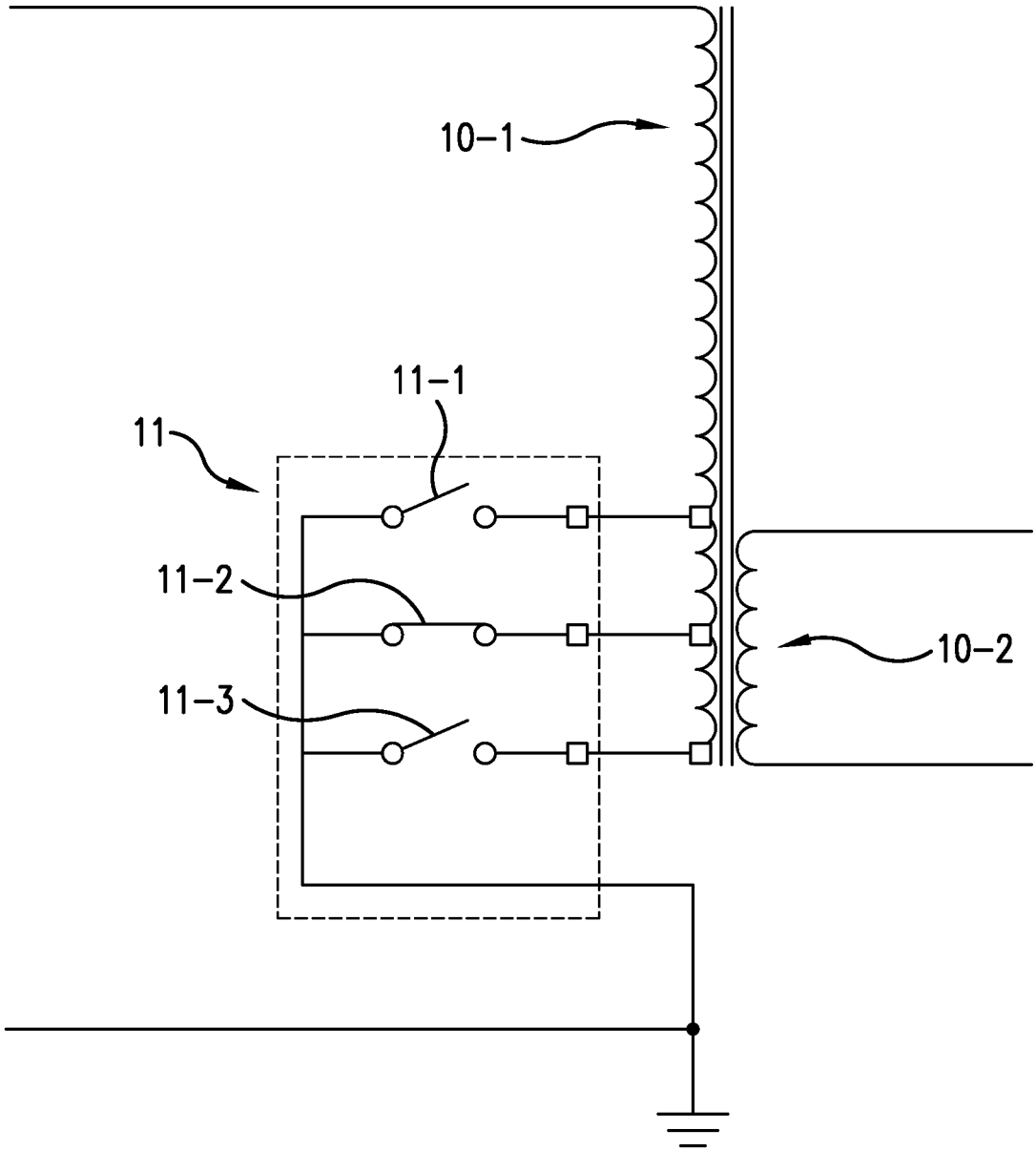
FIG. 1*c* illustrates a conventional transformer cell, of which primary and secondary windings are electrically connected to tap switches.

Exemplary embodiments of the present invention are described in detail with reference to the appended Figures. Like reference numerals denote like elements throughout the drawings.

Figure 2A:
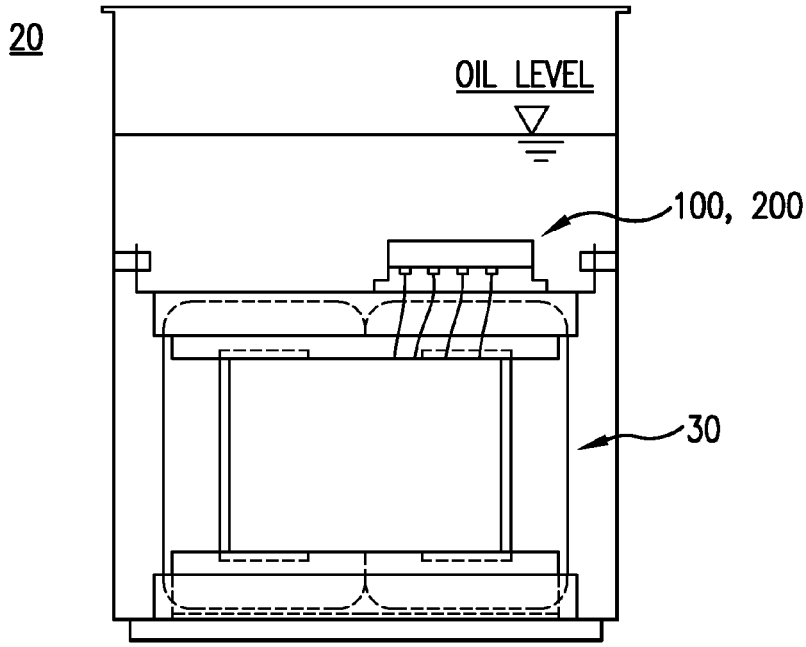
FIG. 2*a* is a schematic view of a transformer having a switching device equipped with an uninterruptible power supply function according to an exemplary embodiment of the present invention.

FIG. 2*a* is a schematic view of a transformer having a switching device equipped with an uninterruptible power supply function according to an exemplary embodiment of the present invention.

Referring to FIG. 2*a*, the transformer 20 may have a structure with no hand-hole cover for tap adjustment. The transformer 20 may be equipped with a switching device 100 or 200 having an uninterruptible power supply function which is insulated with insulation oil. The transformer 20 may be produced in an airtight type to prevent foreign matter and water from penetrating therein. The transformer 20 may include a transformer cell 30 which includes an iron core wound with primary and secondary coils to transform a primary winding voltage of 13,800V, 13,200V and 12,600V to a secondary winding voltage of 240V, 230V and 220V, respectively.

Figure 2B:
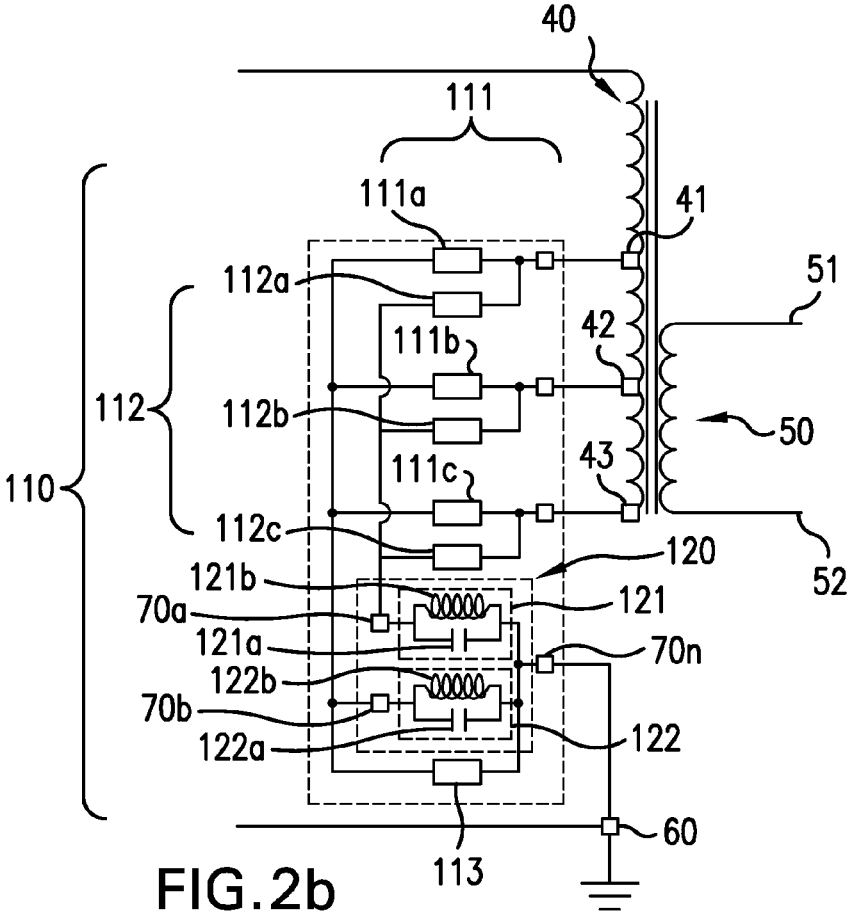
FIG. 2*b* is a wiring diagram of a transformer having a switching unit and a current circulation unit for multiple switches of a switching device equipped with an uninterruptible power supply function.

FIG. 2*b* is a wiring diagram of a transformer having a switching unit and a current circulation unit for multiple switches of a switching device equipped with an uninterruptible power supply function. A control unit is not shown in FIG. 2*b*. FIG. 2*b* illustrates a wiring diagram in which a contact point varies depending on a turn ratio of a primary winding 40 to a secondary winding 50. Reference numeral 43 denotes a point of the primary winding 40 having a voltage of 13,800V which is drawn from a high-voltage power line. Reference numeral 42 denotes a point of the primary winding 40 having a voltage of 13,200V which is drawn from a high-voltage power line. Reference numeral 41 indicates a point of the primary winding 40 having a voltage of 12,600V which is drawn from a high-voltage power line. The respective voltages at the reference numerals 41, 42 and 43 are transformed to secondary voltages at reference numerals 51 and 52 of the secondary winding 50 by the turn ratio of the primary winding 40 to the secondary winding 50. That is, when the primary winding 40 is at 13,800V, the secondary winding 50 is set to a highest voltage; when the primary winding 40 is at 13,200V, the secondary winding 50 is set to a mid-range voltage; and when the primary winding 40 is at 12,600V, the secondary winding 50 is set to a lowest voltage.

Figure 2C:
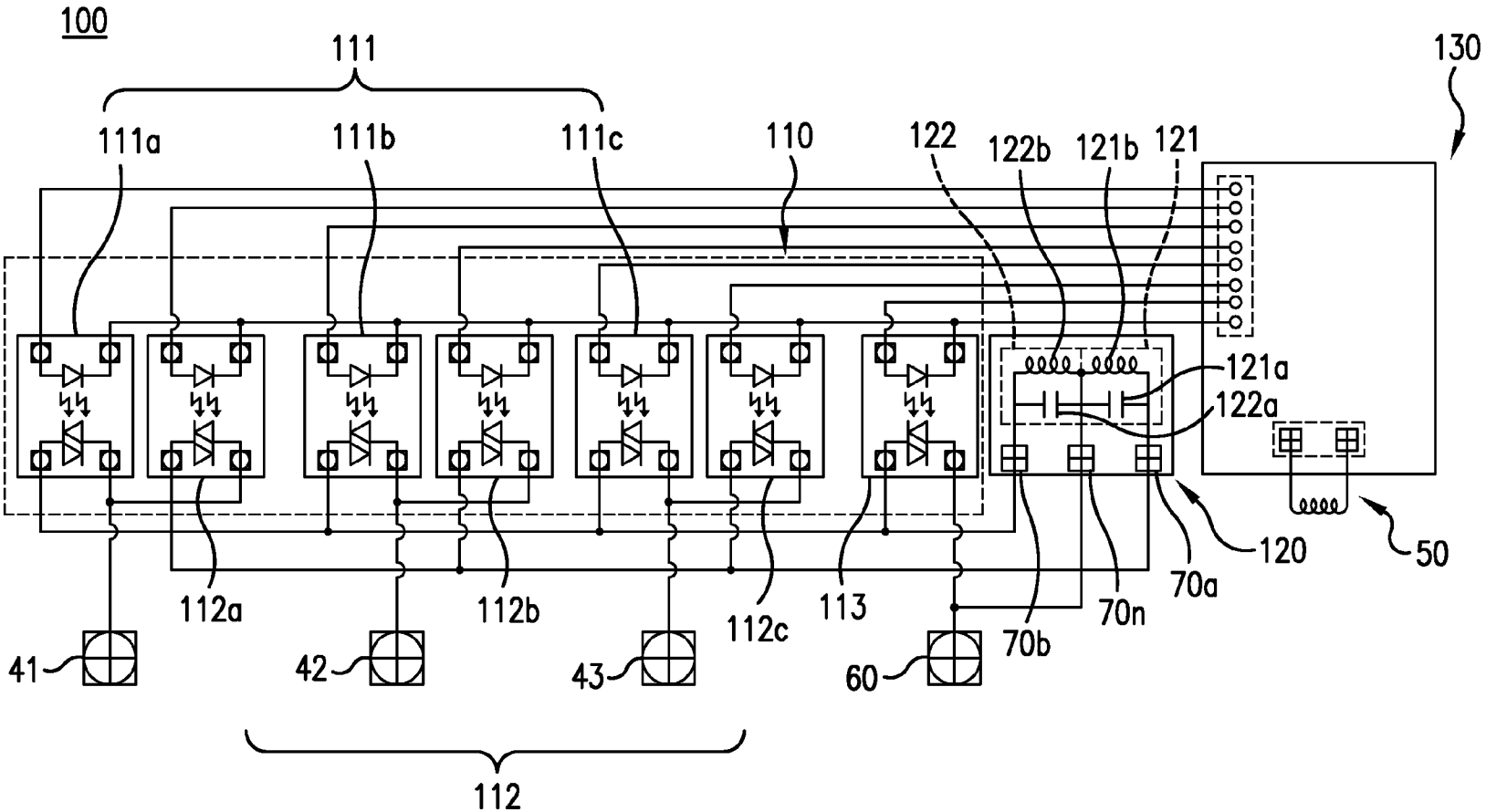
FIG. 2*c* is a circuit diagram of a switching device equipped with an uninterruptible power supply function.
Figure 2D:
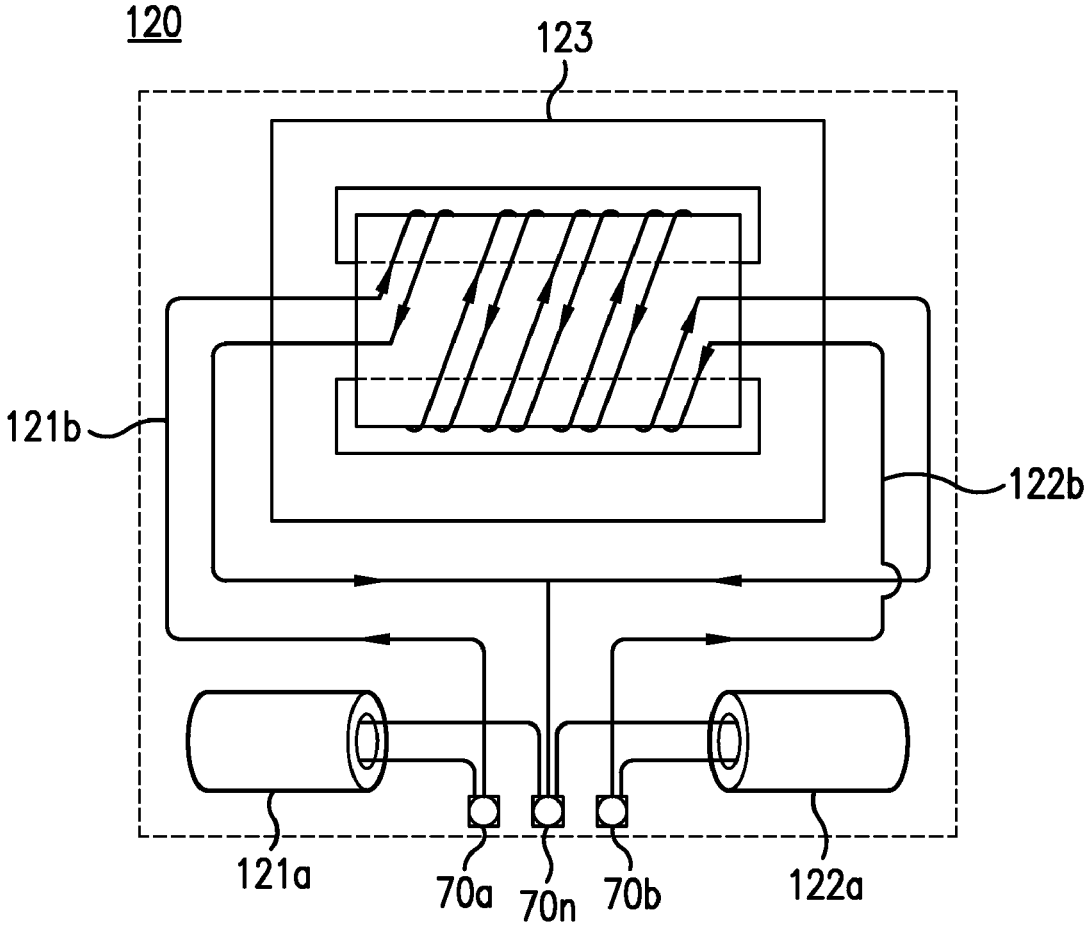
FIG. 2*d* is a schematic view of the current circulation unit shown in FIGS. 2*b* and 2*c*.

FIG. 2*c* is a circuit diagram of a switching device equipped with an uninterruptible power supply function. FIG. 2*d* is a schematic view of a current circulation unit shown in FIGS. 2*b* and 2*c*.

Referring to FIGS. 2*b* and 2*c*, the switching device 100 includes a switching unit 110, a current circulation unit 120 for multiple switches, and a control unit 130. FIG. 2*b* does not show the control unit 130 for better understanding of the drawing.

The switching unit 110 includes a path-selection switch 111, a current-circulation switch 112, and a bypass switch 113. The switch may be formed of an Insulated Gate Bipolar Transistor (IGBT) or a thyristor (SCR). The IGBT can switch with a very rapid response speed in high-power applications, and the thyristor can perform a stable switching operation in high-power applications, thereby performing a stable, reliable switching operation in a high-voltage transformer.

The path-selection switch 111 is electrically connected to the primary winding 40 on a large-current path. The path-selection switch 111 includes a first path-selection switch 111*c* to connect a 13,800V point 43 of the primary winding 40, a second path-selection switch 111*b* to connect a 13,200V point 42 of the primary winding 40, and a third path-selection switch 111*a* to connect a 12,600V point 41 of the primary winding 40. The path-selection switch 111 electrically connects any point of the primary winding 40 by switching on one of the first, second and third path-selection switches 111*a*, 111*b* and 111*c* under control of the control unit 130.

The current-circulation switch 112 is electrically connected to the primary winding 40 on a large-current path. The current-circulation switch 112 includes a first current-circulation switch 112*c* to circulate current at the 13,800V point 43 of the primary winding 40, a second current-circulation switch 112*b* to circulate current at the 13,200V point 42, and a third current-circulation switch 112*a* to circulate current at the 12,600V point 41. The current-circulation switch 112 electrically connects one of the points of the primary winding 40 to the current circulation unit 120 under the control of the control unit 130.

The bypass switch 113 connects a first bypass part 121 and a second bypass part 122, which are connected to a ground 60, to the path-selection switch 111. In FIG. 2*b*, the bypass switch 113 connects the first, second and third path-selection switches 111*a*, 111*b* and 111*c* to a point 70*b* of the second bypass part 122 which is electrically connected to the ground 60.

The current circulation unit 120 for multiple switches includes the first bypass part 121, the second bypass part 122, and an iron core. The first bypass part 121 includes a first capacitor 121*a* and a first coil 121*b*. The second bypass part 122 includes a first capacitor 122*a* and a second coil 122*b*. The first and second bypass parts 121 and 122 are electrically connected at one point with each other and are also connected to the ground 60. The other point of the first bypass part 121 is electrically connected to the current-circulation switch 112, and the other point of the second bypass part 122 is electrically connected to the path-selection switch 111. FIG. 2*d* is a detailed view of the current circulation unit 120 for multiple switches shown in FIG. 2*b*. As shown in FIG. 2*d*, an iron core 123 is inserted between the first and second coils 121*b* and 122*b* and wound with the first and second coils 121*b* and 122*b*, which are connected in parallel with the first and second capacitors 121*a* and 122*a*, respectively.

Operation of the current circulation unit 120 for multiple switches is described with reference to FIGS. 2*b* and 2*d*. The current circulation unit 120 for multiple switches prevents circulating current from being produced when two or more points of the primary windings 40 contact the ground 60 through the switches. For example, when the 13,200V point 42 of the primary winding is connected to the ground 60 while the 13,800V point 43 of the primary winding 40 is connected to the ground 60, a voltage difference of about 600V occurs and electric current is thus produced. At this time, the current circulation unit 120 for multiple switches circulates the current as follows: since the current flows from reference numeral 70*a* to reference numeral 70*n* of the current circulation unit 120 shown in FIG. 2*b* by a voltage difference of 600V, current flows from 70*n* to 70*b*, thereby circulating the current. Hence, the current produced by the voltage difference can be attenuated by the current circulation unit 120 for multiple switches.

At this time, in the current circulation unit 120 for multiple switches, the first capacitor 121*a* connected in parallel with the points 70*a* and 70*n*, and the second capacitor 122*a* connected in parallel with the points 70*b* and 70*n* can prevent noise and surge voltage caused by circulating current. The current circulation unit 120 for multiple switches can be referred to as an uninterruptible bypass unit or other terms.

The control unit 130 measures the voltage of the second winding 50, is electrically connected to a plurality of switches 111, 112 and 113, and applies signals to the switches 111, 112 and 113 to sequentially switch the switches 111, 112 and 113. When the first path-selection switch 111*c* is switched on so that the primary winding 40 is connected to the 13,800V point 43, the control unit 130 switches off the first path-selection switch 111*c*, if the secondary winding 50 has too low voltage, e.g. about 210V, which is measured by the control unit 130. At the same time, the control unit 130 switches on the second path-selection switch 111*b* to switch to the 13,200V point 42 of the primary winding 40 and to boost the voltage of the secondary winding 50. Further, when the second path-selection switch 111*b* is switched on so that the primary winding 40 is connected to the 13,200V point 42, the control unit 130 switches off the second path-selection switch 111*b* if the secondary winding 50 has too low voltage, e.g. about 210V, which is measured by the control unit 130. At the same time, the control unit 130 switches on the third path-selection switch 111*a* to switch to the 12,600V point 41 of the primary winding 40 and to boost the voltage of the secondary winding 50. The control unit 130 includes passive elements, active elements, integrated circuits and other electric elements to sequentially operate a plurality of switches.

Figure 2E:
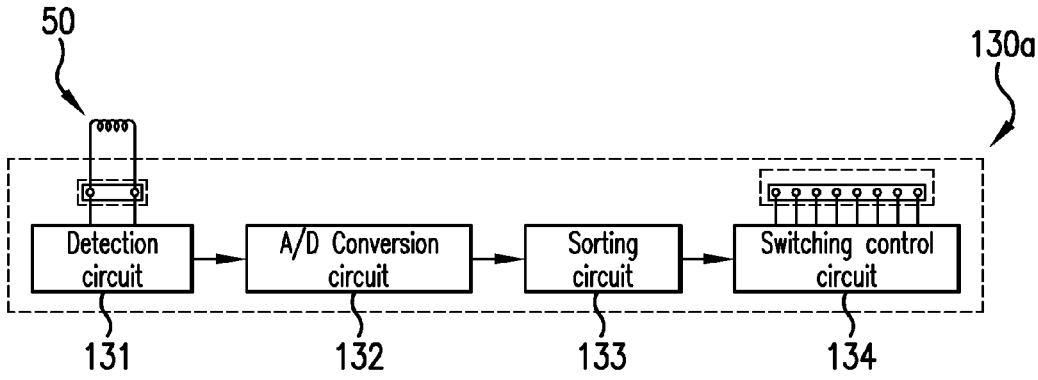
FIG. 2*e* is a schematic view of a control unit.

FIG. 2*e* illustrates a control unit shown in FIG. 2*c*.

Referring to FIG. 2*e*, the control unit 130*a* includes a detection circuit 131, an A/D conversion circuit 132, a sorting circuit 133, and a switching control circuit 134 to select switches by the secondary winding voltage.

The detection circuit 131 is electrically connected to the secondary winding 50 to detect voltage. The A/D conversion circuit 132 converts the voltage to a digital signal. The sorting circuit 133 sorts digital signals by a predetermined range, and outputs a signal corresponding to the predetermined range. The switching control circuit 134 selectively outputs signals to switches based on the signals outputted from the sorting circuit 133. The control unit 130*a*, which includes the detection circuit 131, the A/D conversion circuit 132, the sorting circuit 133, and the switching control circuit 134, may be formed selectively using electrical elements such as passive elements, active elements and integrated circuits.

Figure 2F:
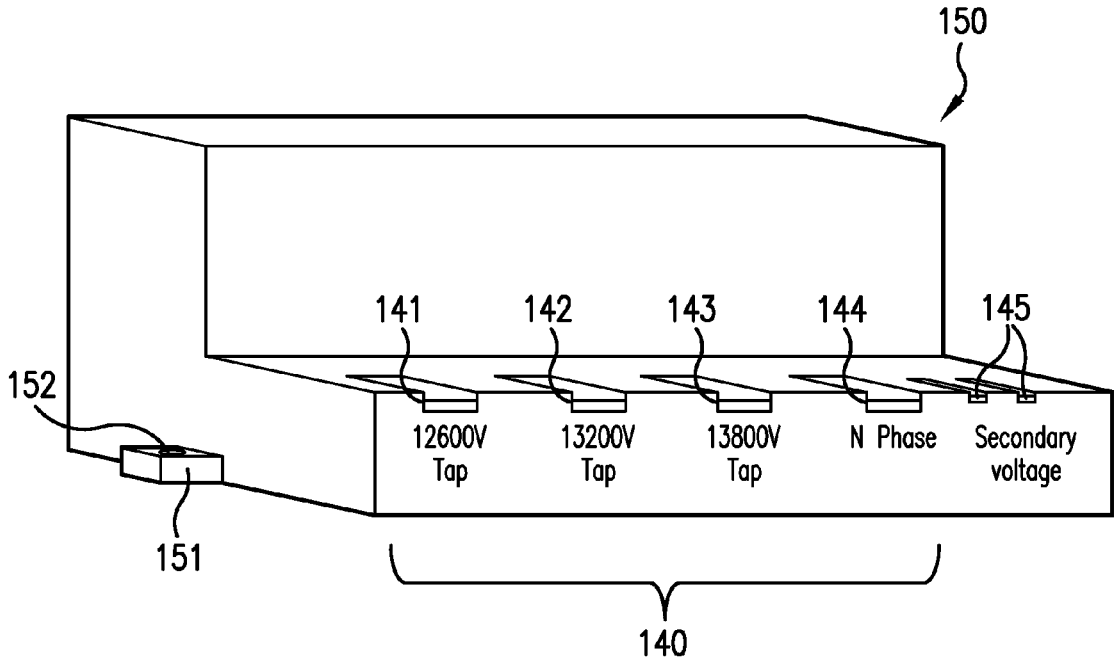
FIG. 2*f* illustrates a switching unit, a current circulation unit and a control unit, which are enclosed in an insulator.

FIG. 2*f* illustrates a switching unit, a current circulation unit for multiple switches, and a control unit, which are enclosed in an insulator.

Referring to FIG. 2*f*, the switching device having an uninterruptible power supply function further includes an external connection terminal 140 and an insulator 150.

The switching unit, the current circulation unit and the control unit, which are enclosed by the insulator 150 made of rubbers, plastics, ceramic materials, etc., are electrically connected to the primary winding through a 12,600V external connection terminal 141, which is electrically connected to the 12,600V point of the primary winding, a 13,200V external connection terminal 142, which is electrically connected to the 13,200V point of the primary winding, and a 13,800V external connection terminal 143, which is electrically connected to the 13,800V point of the primary winding. The ground is electrically connected to an N-phase external connection terminal 144. The control unit may have a secondary voltage measurement terminal 145 to measure the voltage of a point of the secondary winding. As described above, the switching unit, the current circulation unit and the control unit are electrically connected to the external connection terminal 140, and are insulated by and enclosed in the isolator 150. The isolator 150 may have a protrusion 151 with a hole 152 therein so that it can be fixed to the transformer by a coupling device.

Figure 2G:
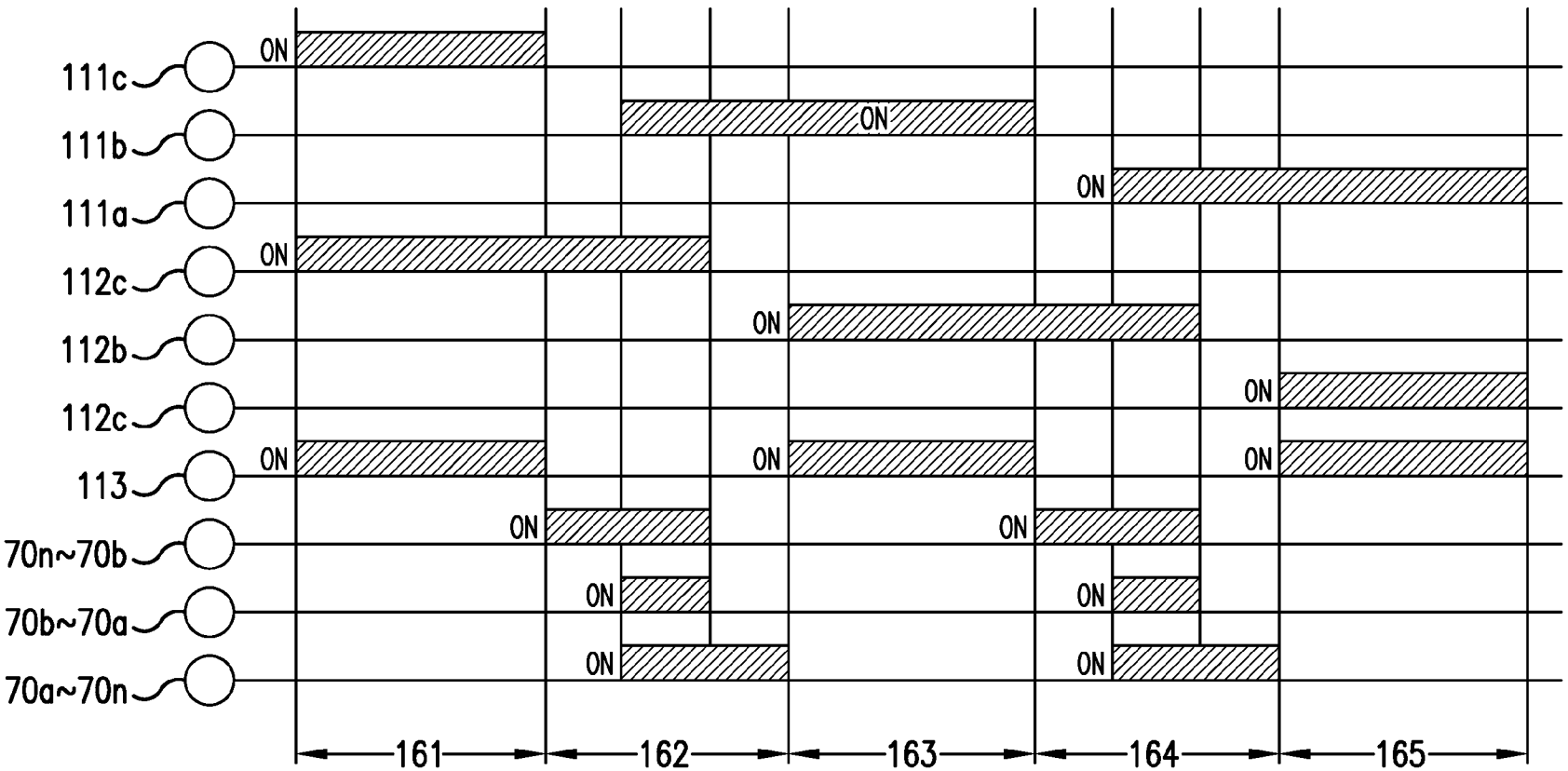
FIG. 2*g* is a time chart of operation of a switching device equipped with an uninterruptible power supply function.

FIG. 2*g* is a time chart of operation of a switching device having an uninterruptible power supply function. In more detail, FIG. 2*g* is a time chart of the switching unit and the current circulation unit for multiple switches which are switched on and off. In FIG. 2*g*, the transverse axis shows a segment 161, in which the 13,800V point of the primary winding is switched on, a segment 162, in which the 13,800V point and the 13,200V point are simultaneously switched on, a segment 163, in which the 13,200V point is switched on, a segment 164, in which the 13,200V point and the 12,600V point are simultaneously switched on, and a segment 165, in which the 12,600V point is switched on. The longitudinal axis shows the switching unit and the current circulation unit for multiple switches, which are switched on and off.

The operation of the switching device having an uninterruptible power supply function is described with reference to FIGS. 2*b* and 2*g*.

The segment 161, in which the 13,800V point 43 is switched on, is set by switching on the first path-selection switch 111*c* and the bypass switch 113 to electrically connect to the 13,800V point. Simultaneously, the first current circulation switch 112*c* is also switched on.

The segment 162, in which the 13,800V point 43 and the 13,200V point 42 are simultaneously switched on, is set by switching on the first current circulation switch 112*c* and switching off the first path selection switch 111*c* and the bypass switch 113, resulting in current flowing from the point 70*n* to the point 70*b* of the current circulation unit for multiple switches. At this time, switching on the second path selection switch 111*b* causes a voltage difference of 600V. At the moment when the voltage difference of 600V occurs, the current circulation unit 120 for multiple switches 120 operates to allow the current to flow from the point 70*b* to the point 70*n* to circulate the current in the opposite direction. Therefore, it is possible to switch from the 13,800V point 43 to the 13,200V point 42 without power interruption.

The segment 163, in which the 13,200V point of the primary winding is switched on, is set by switching on the second current circulation switch 112*b* and the bypass switch 113 while the second path selection switch 111*b* is being switched on.

Then, the segment 164, in which the 13,200V point 42 and the 12,600V point 41 of the primary winding are simultaneously switched on, is set by switching off the second path selection switch 111*b* and the bypass switch 113 while the second current circulation switch 112*b* is being switched on, resulting in current flowing from the point 70*n* to the point 70*b* of the current circulation unit 120 for multiple switches. At this time, when the third path selection switch 111*a* is switched on, a voltage difference of 600V occurs. At the moment when the voltage difference of 600V occurs, the current circulation unit 120 for multiple switches 120 operates to allow the current to flow from the point 70*b* to the point 70*n* to circulate the current in the opposite direction. Therefore, it is possible to switch from the 13,200V point 42 to the 12,600V point 41 without power interruption Next, the segment 165, in which the 12,600V point 41 of the primary winding is switched on, is set by switching on the first current circulation switch 112*a* and the bypass switch 113 while the third path selection switch 111*a* is being switched on.

Since the switching device having an uninterruptible power supply function can supply power even when the primary winding 40 is being switched, the switching device can supply power without interruption to a load which is electrically connected to the secondary winding 50. In addition, the switching device can stably supply power to the load electrically connected to the secondary winding 50 by regulating the voltage, which is dropped on and output from the secondary winding 50 of the transformer, within the range between 220V and 236V.

Figure 3A:
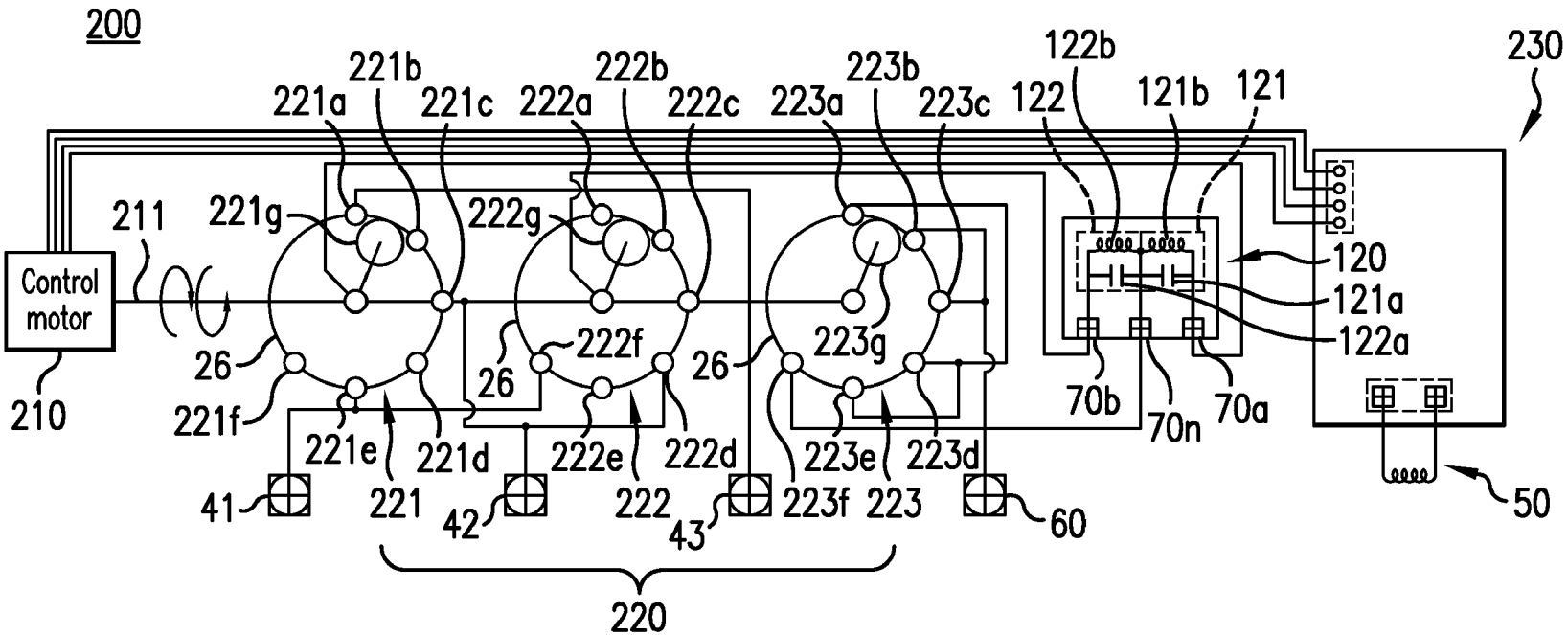
FIG. 3*a* is a schematic view of a switching device equipped with an uninterruptible power supply function.

FIG. 3*a* is a schematic view of a switching device for a transformer which has an uninterruptible power supply function. In this example embodiment, the same elements as those shown in the other figures are denoted by the same reference numerals and are thus not described in detail herein.

Referring to FIG. 3*a*, a switching device 200 having an uninterruptible power supply function includes a motor 210, a rotary switch 220, a current circulation unit 120 for multiple switches, and a control unit 230.

The motor 210 is driven by a control signal. The motor 210 includes, but is not limited to, an AC motor or a DC motor driven by a PWM control method, or a stepping motor controlled by a pulse operating method.

The rotary switch 220 is sequentially coupled with a rotating shaft of the motor and has a plurality of contact points. The rotary switch 220 may include a first rotary switch 221, a second rotary switch 222, and a third rotary switch 233. Each of the first, second and third rotary switches 221, 222, and 233 has a switch attachment plate 26 to form a plurality of contact points thereon. The contact points can be electrically connected to the external connection terminals and the current circulation unit for multiple switches.

The first rotary switch 221 has six contact points 221*a*, 221*b*, 221*c*, 221*d*, 221*e* and 221*f*, of which three contact points 221*a*, 221*c* and 221*e* are used to make an electrical connection. Among the three contact points of the first rotary switch 221, the first contact point 221*a* is electrically connected to the 13,800V point 43 of the primary winding; the third contact point 221*c* is connected to the 13,200V point 42; and the fifth contact point 221*e* is connected to the 12,600V point 41. The first rotary switch 221 has a first movable contact 221*g*, which is electrically connected to any one of the contact points of the first rotary switch 221 and is thus electrically connected to the point 70*a* of the current circulation unit 120 for multiple switches.

The second rotary switch 222 has six contact points 222*a*, 222*b*, 222*c*, 222*d*, 222*e* and 222*f*, of which three contact point points 222*b*, 222*d* and 222*f* are used to make an electrical connection. Among the three contact points of the second rotary switch 222, the second contact point 222*b* is electrically connected to the 13,800V point 43 of the primary winding and the first contact point 221*a* of the first rotary switch 221; the fourth contact point 222*d* is connected to the 13,200V point 42 and the third contact point 221*c* of the first rotary switch 221; and the sixth contact point 222*f* is connected to the 12,600V point 41. The second rotary switch 222 has a second movable contact 222*g*, which is electrically connected to any one of the contact points of the second rotary switch 222 and is thus electrically connected to a point 70*b* of the current circulation unit for multiple switches 120.

The third rotary switch 223 has six contact points 223*a*, 223*b*, 223*c*, 223*d*, 223*e* and 223*f* which are used to make an electrical connection. Among the six contact points of the third rotary switch 223, the first contact point 223*a* is electrically connected to the fourth and fifth contact points 223*d* and 223*e*; and the second contact point 223*b* is connected to the third and sixth contact points 223*c* and 223*f*, the ground 60, and the point 70*n* of the current circulation unit 120 for multiple switches. The third rotary switch 223 has a third movable contact 223*g*, which is electrically connected to any neighboring two of the contact points of the third rotary switch 223.

The current circulation unit 120 for multiple switches is electrically connected to the contact points of the rotary switch 220. When the rotary switch 220 rotates and the contact points of the rotary switch 220 are thus switched, current is circulated through contact points of the rotary switch which are connected to each other. The current circulation unit for multiple switches is described above and a detailed description thereof is thus omitted herein.

The control unit 230 sends a control signal to rotate the motor so that the contact points of the rotary switch 220 are switched. As shown in FIG. 3*a*, the first, second and third rotary switches 221, 222 and 223 are coupled to the rotating shaft 211 of the motor 210 which passes through the switch attachment plate 26, so that the rotary switches simultaneously move when the motor 10 rotates.

The control unit 230 measures the voltage of the secondary winding 50 and sequentially rotates the motor 210 at regular angles depending on the voltage of the secondary winding 50. The control unit 230 may be formed selectively using electrical elements such as passive elements, active elements and integrated circuits.

Figure 3B:
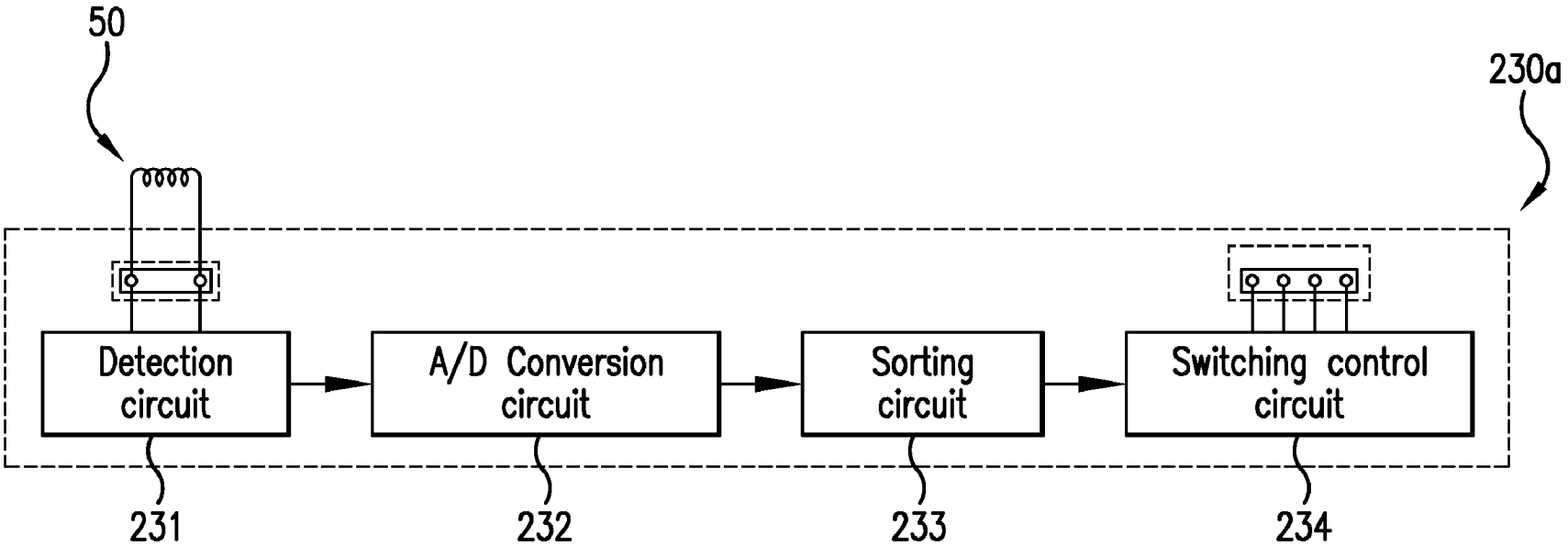
FIG. 3*b* is a schematic view of a control unit.

FIG. 3*b* is a block diagram of the control unit shown in FIG. 3*a*.

Referring to FIG. 3*b*, the control unit 230*a* includes a detection circuit 231, an A/D conversion circuit 232, a sorting circuit 233, and a motor drive circuit 234. The detection circuit 231 measures the voltage of the secondary winding 50. The A/D conversion circuit 232 converts the voltage into a digital signal. The sorting circuit 233 sorts digital signals by a predetermined range, and outputs a signal corresponding to the predetermined range. The digital signals may be sorted in steps by determining whether the voltage measured in the secondary winding 50 belongs to a range in each step of a predetermined reference voltage. The motor drive circuit 234 sequentially rotates the motor 210 at regular angles by the signal outputted from the sorting circuit 233 to switch the contact points of the rotary switch. The control unit 230*a* may be formed selectively using electrical elements such as passive elements, active elements and integrated circuits. The sorting circuit may be equipped with a sequence program for driving the motor.

Operation of the switching device having the uninterruptible power supply function will be described with reference to FIGS. 3*c* to 3*h*. FIGS. 3*c* to 3*g* illustrate the operation of the respective movable contacts of first, second and third rotary switches in the switching device shown in FIG. 3*a*. FIG. 3*h* is a table indicating switching on/off of the primary winding when the respective movable contacts of the rotary switches shown in FIGS. 3*c* to 3*g* are connected to a plurality of contact points.

Figure 3C:
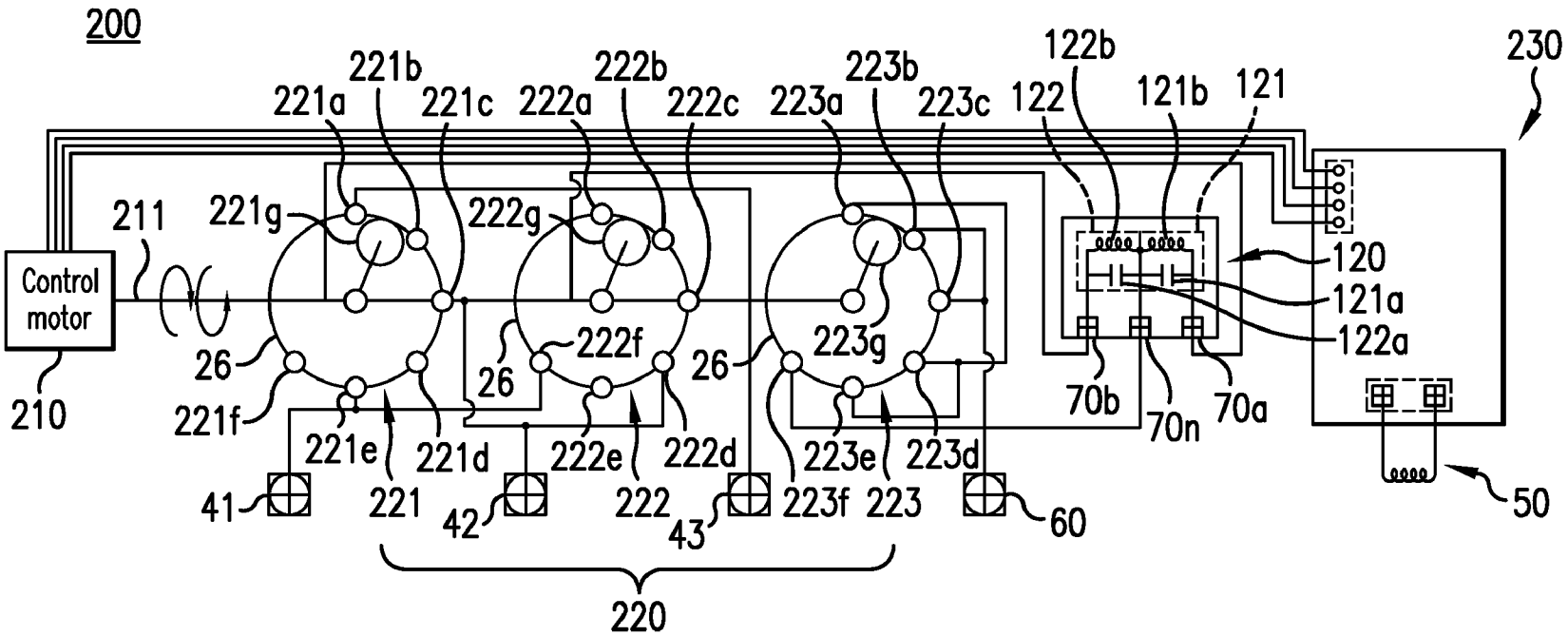
FIGS. 3*c* to 3*g* illustrate operation of the respective movable contacts of first, second and third rotary switches in a switching device shown in FIG. 3*a*.

Referring to FIG. 3*c*, the first, second and third rotary switches 221, 222 and 223 have movable contacts 221*g*, 222*g* and 223*g*, respectively, which are connected to the first contact points 221*a*, 222*a* and 223*a* and the second contact points 221*b*, 222*b* and 223*b*, respectively. Referring to FIG. 3*h*, when a movable contact is electrically connected between the first and second contact points (1-2), the ground 60 and the 13,800V point 43 are switched on.

Figure 3D:
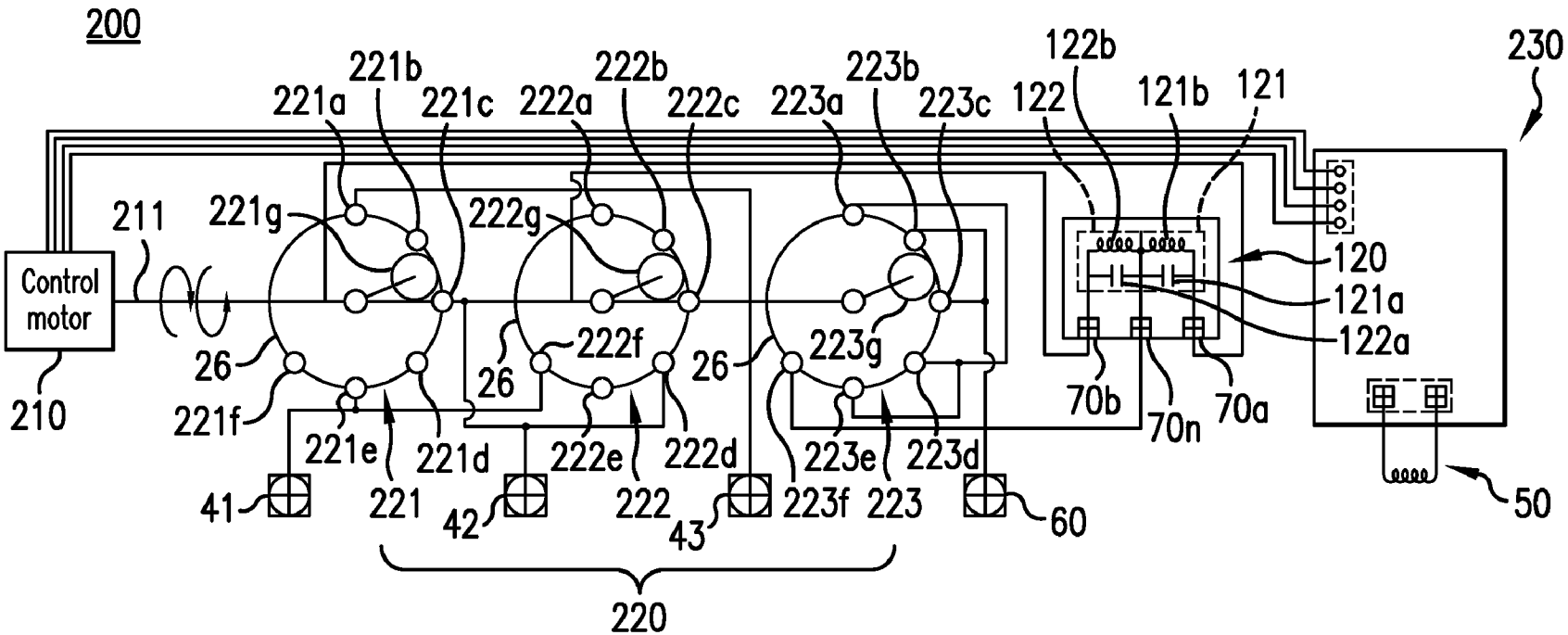

Referring to FIG. 3*d*, the first, second and third rotary switches 221, 222 and 223 have the movable contacts 221*g*, 222*g* and 223*g*, respectively, which are connected to the second contact points 221*b*, 222*b* and 223*b* and the third contact points 221*c*, 222*c* and 223*c*, respectively. Referring to FIG. 3*h*, when a movable contact is electrically connected between the second and third contact points (2-3), the 13,800V point 43 and the 13,200V point 42 are simultaneously switched on. At this time, the 13,800V point 43 and the 13,200V point 42 of the primary winding are all switched on, causing a voltage difference of 600V. In this case, the current circulation unit 120 operates to attenuate the current caused by the voltage difference of 600V, resulting in maintaining uninterrupted power supply.

Figure 3E:
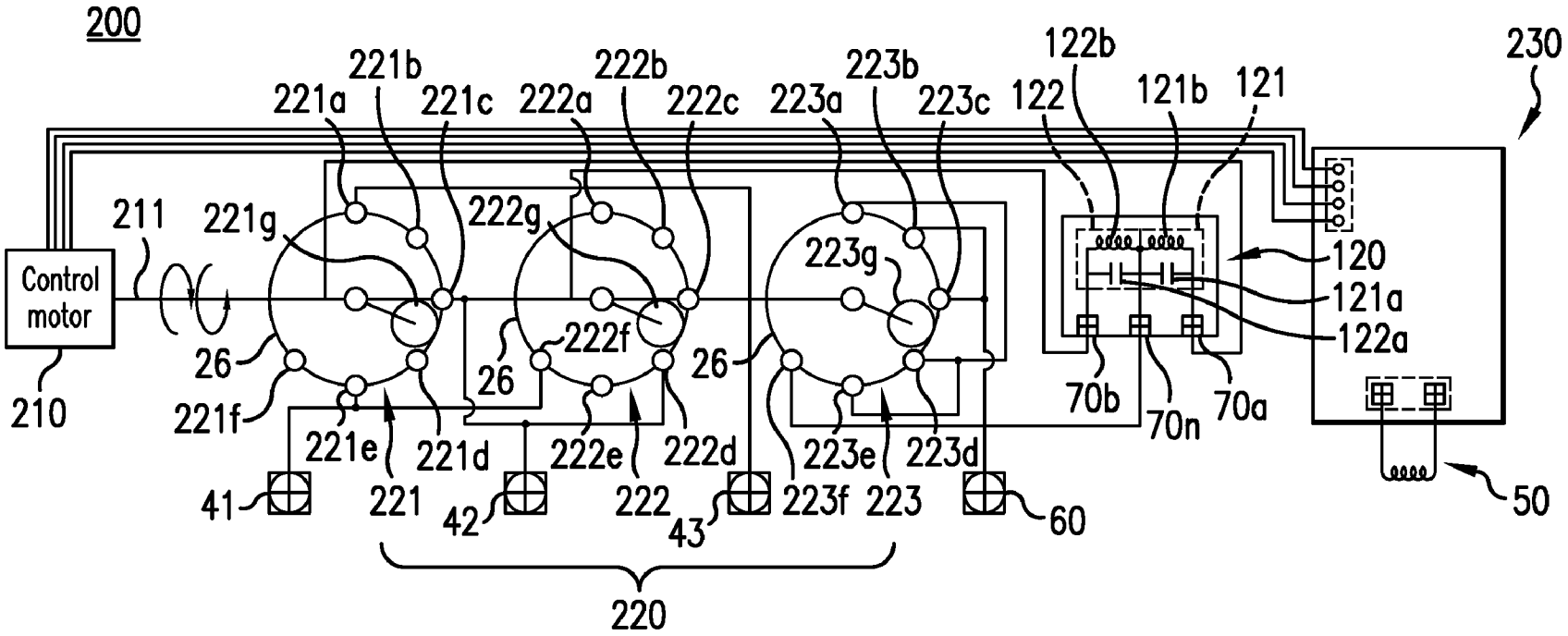

Referring to FIG. 3*e*, the third contact points 221*c*, 222*c* and 223*c* and fourth contact points 221*d*, 222*d* and 223*d* of the first, second and third rotary switches 221, 222 and 223 are connected to the third contact points 221*c*, 222*c* and 223*c* and fourth contact points 221*d*, 222*d* and 223*d* of the rotary switches 221, 222 and 223, respectively. Referring to FIG. 3*h*, when a movable contact is electrically connected between the third and fourth contact points (3-4), the ground 60 and the 13,200V point are switched on.

Figure 3F:
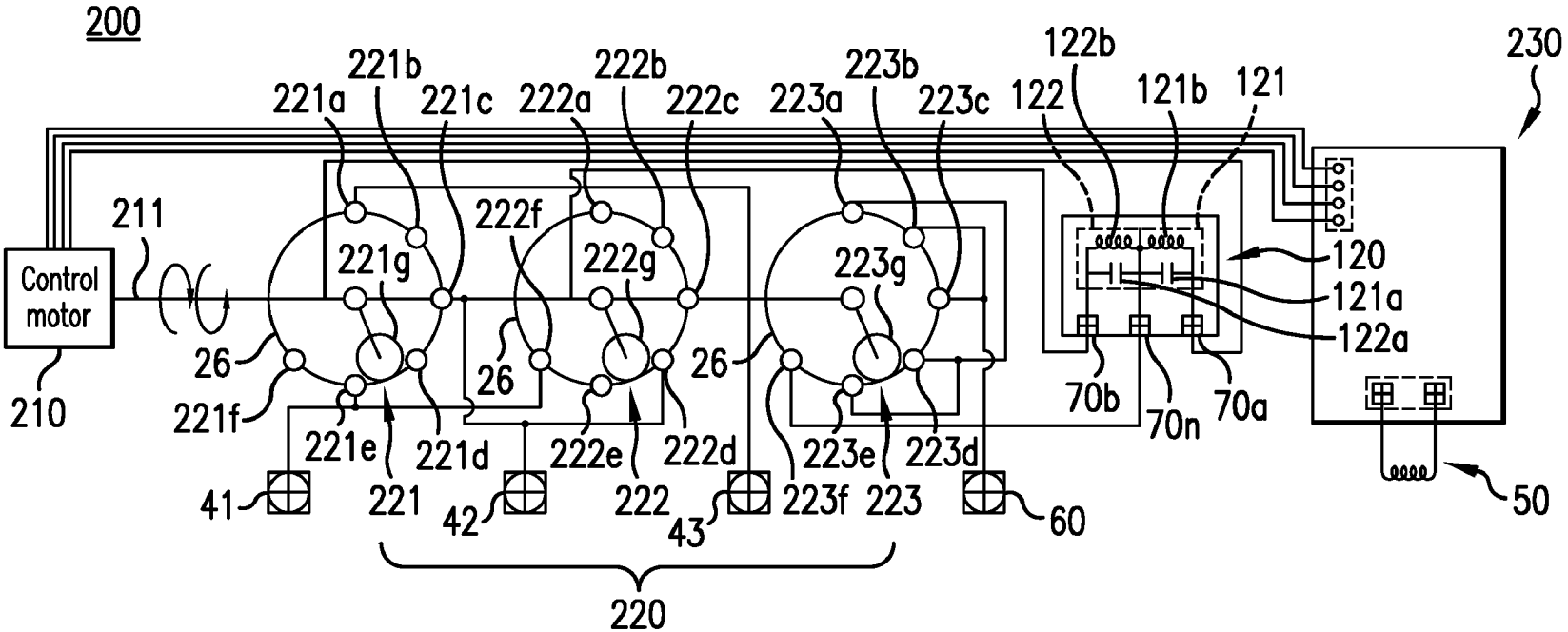

As shown in FIG. 3*f*, the movable contacts 221*g*, 222*g* and 223*g* of the first, second and third rotary switches 221, 222 and 223 are connected to the fourth contact points 221*d*, 222*d* and 223*d* and the fifth contact points 221*e*, 222*e* and 223*e* of the rotary switches, respectively. Referring to FIG. 3*h*, when movable contacts are electrically connected between the fourth and fifth contact points (4-5), the 13,200V point 42 and the 12,600V point 41 are simultaneously switched on. At this time, the 13,200V point 42 and the 12,600V point 41 of the primary winding are all switched on, causing a voltage difference of 600V. In this case, the current circulation unit 120 operates to attenuate the current caused by the voltage difference of 600V, resulting in maintaining uninterrupted power supply.

Figure 3G:
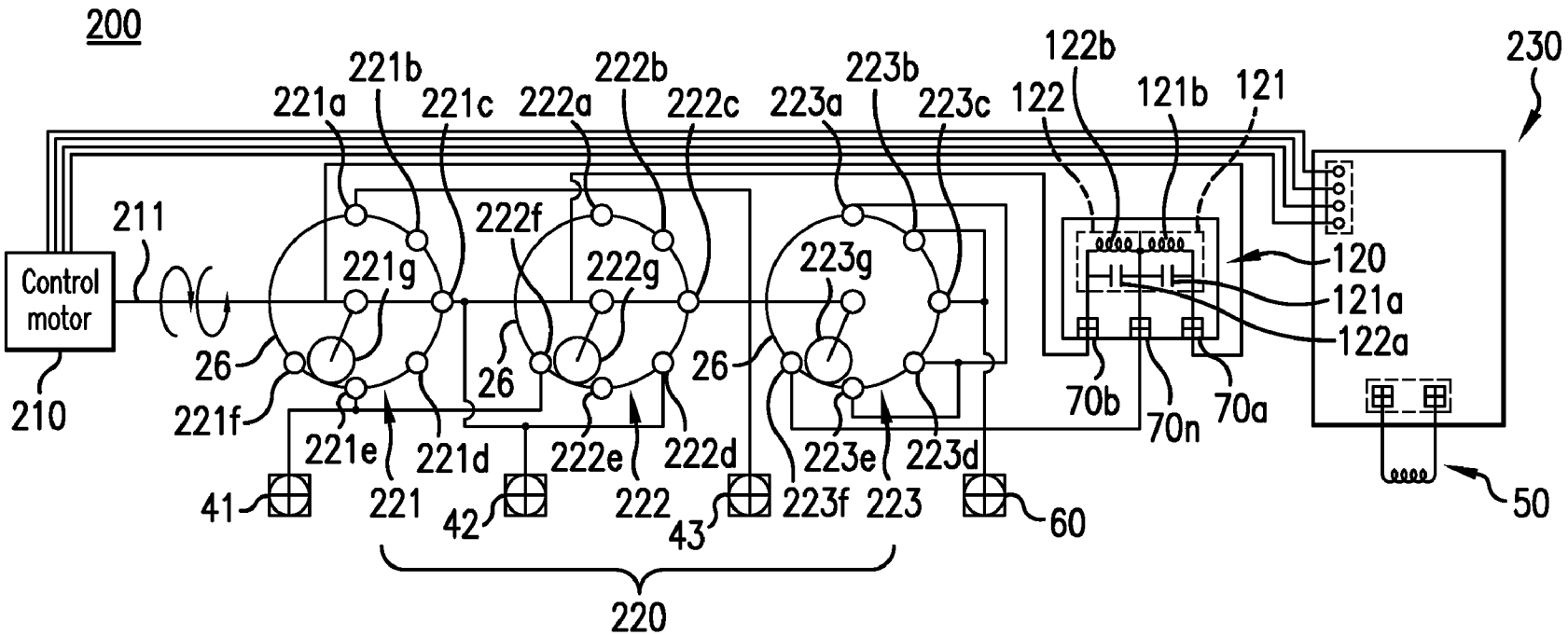

As shown in FIG. 3*g*, the movable contacts 221*g*, 222*g* and 223*g* of the first, second and third rotary switches 221, 222 and 223 are connected to the fifth contact points 221*e*, 222*e* and 223*e* and the sixth contact points 221*g*, 222*g* and 223*g* of the rotary switches, respectively. Referring to FIG. 3*h*, when movable contacts are electrically connected between the fifth and sixth contact points (5-6), the ground 60 and the 12,600V point 41 are simultaneously switched on.

The switching device having an uninterruptible power supply function rotates a plurality of rotary switches connected to the rotating shaft of the motor, thereby making a mechanical switching operation without power interruption. Therefore, it is possible to substantially reduce the malfunction of the switching device which is caused by an external noise or surge voltage.

The motor, the rotary switch, and the current circulation unit for multiple switches are insulated by and enclosed in the isolator while the external connection terminals are exposed. The isolator is described above with reference to FIG. 2*f*, and a detailed description thereof is thus omitted herein.

Figure 4A:
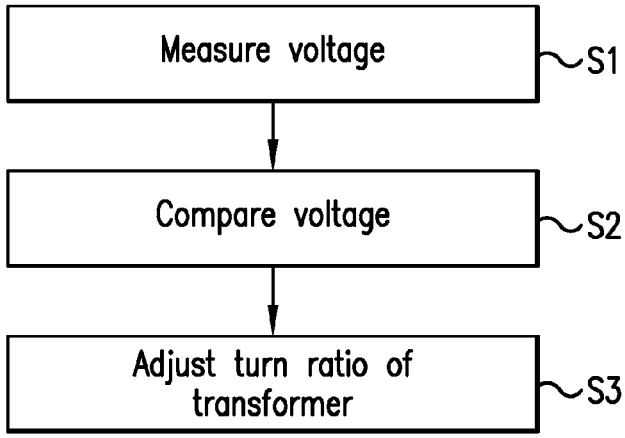
FIG. 4*a* is a flow chart of a method of adjusting a turn ratio of a transformer.
Figure 4B:
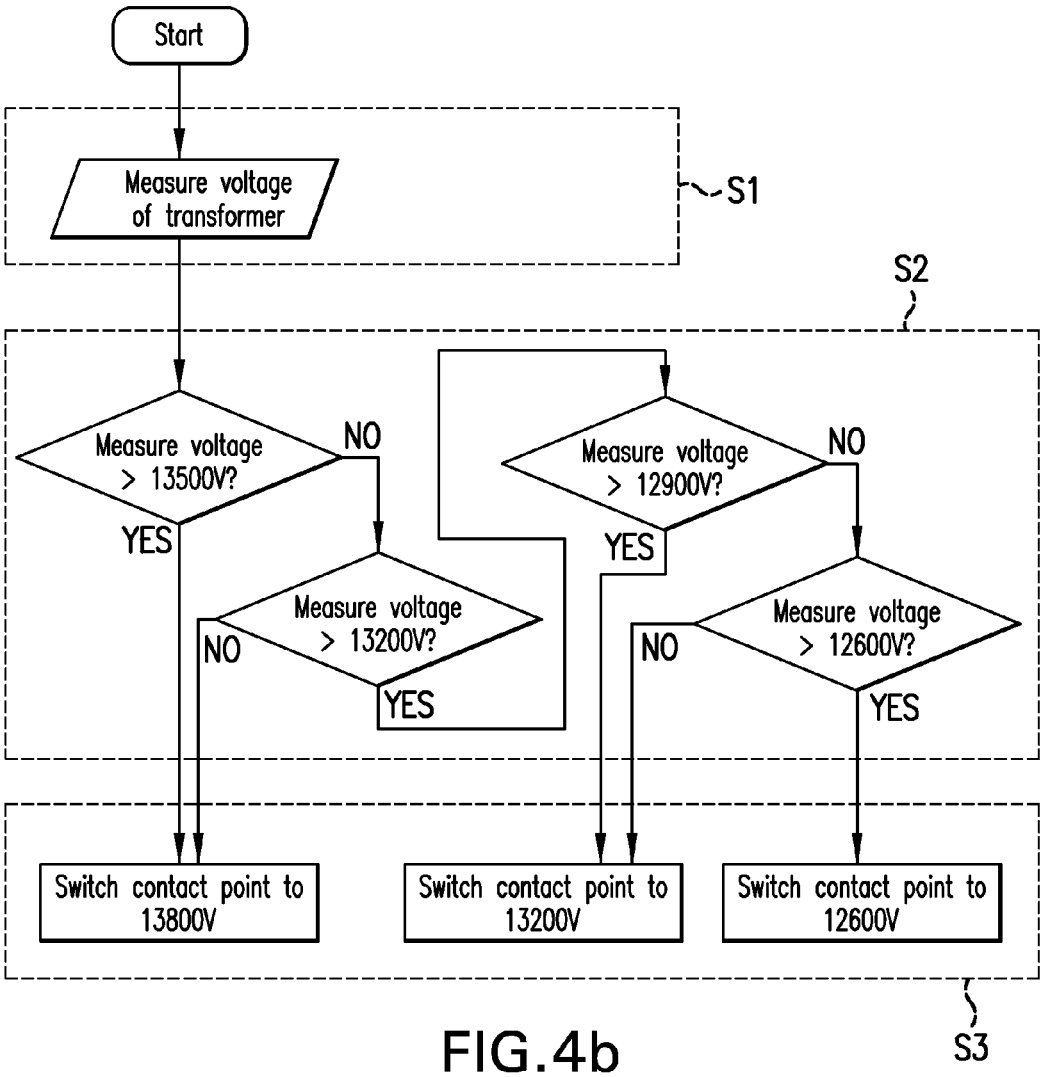
FIG. 4*b* is a detailed flow chart of the method illustrated in FIG. 4*a*.

FIG. 4*a* is a flow chart of a method of adjusting a turn ratio of a transformer. FIG. 4*b* is a detailed flow chart of the method illustrated in FIG. 4*a*.

Referring to FIGS. 4*a* and 4*b*, the method of adjusting a turn ratio of a transformer includes measuring voltage (S1), comparing the voltage (S2), and adjusting a turn ratio of the transformer (S3). The method is described in detail with reference to FIG. 2*c*.

At Operation S1, voltage of the transformer is measured. The voltage of the transformer is measured by measuring a secondary winding voltage or a primary winding voltage of the transformer by the control unit 130 of the switching device 100 having an uninterruptible power supply function.

At Operation S2, the voltage is compared by converting a secondary winding voltage, which is measured by the control unit 130 of the switching device 100 At Operation S1, into a primary winding voltage by the winding ratio, and comparing the primary winding voltage on the basis of 13,500V. If the primary winding voltage is greater than 13,500V, the process proceeds to Operation S3. If the primary winding voltage is not greater than 13,500V, it is compared with 13,200V, which is lower than 13,500V. If the primary winding voltage is smaller than 13,200V, the process proceeds to Operation S3. If the primary winding voltage is greater than 13,200V, it is compared with 12,900V, which is lower than 13,200V. Accordingly, it is possible to set the primary winding voltage to a predetermined range.

At Operation S3, the turn ratio of the transformer is automatically adjusted according to the result of Operation S2. In more detail, if a primary winding voltage is determined to be greater than 13,500V at Operation S2, the switching device equipped with an uninterruptible power supply function sets the primary winding voltage to a 13,800V point 43; if the primary winding voltage is between 13,200V and 12,600V, the switching device sets the primary winding voltage to a 13,200V point 42; if the primary winding voltage is determined to be smaller than 12,600V, the switching device sets the primary winding voltage to a 12,600V point 41.

Furthermore, after the turn ratio of the transformer is automatically changed at Operation S3, voltage is measured again at Operation S1 and the voltage is compared again at Operation S2. For example, the turn ratio is adjusted about every 120 minutes. If the turn ratio is too frequently changed, flicker may occur on the line.

Figure 5:
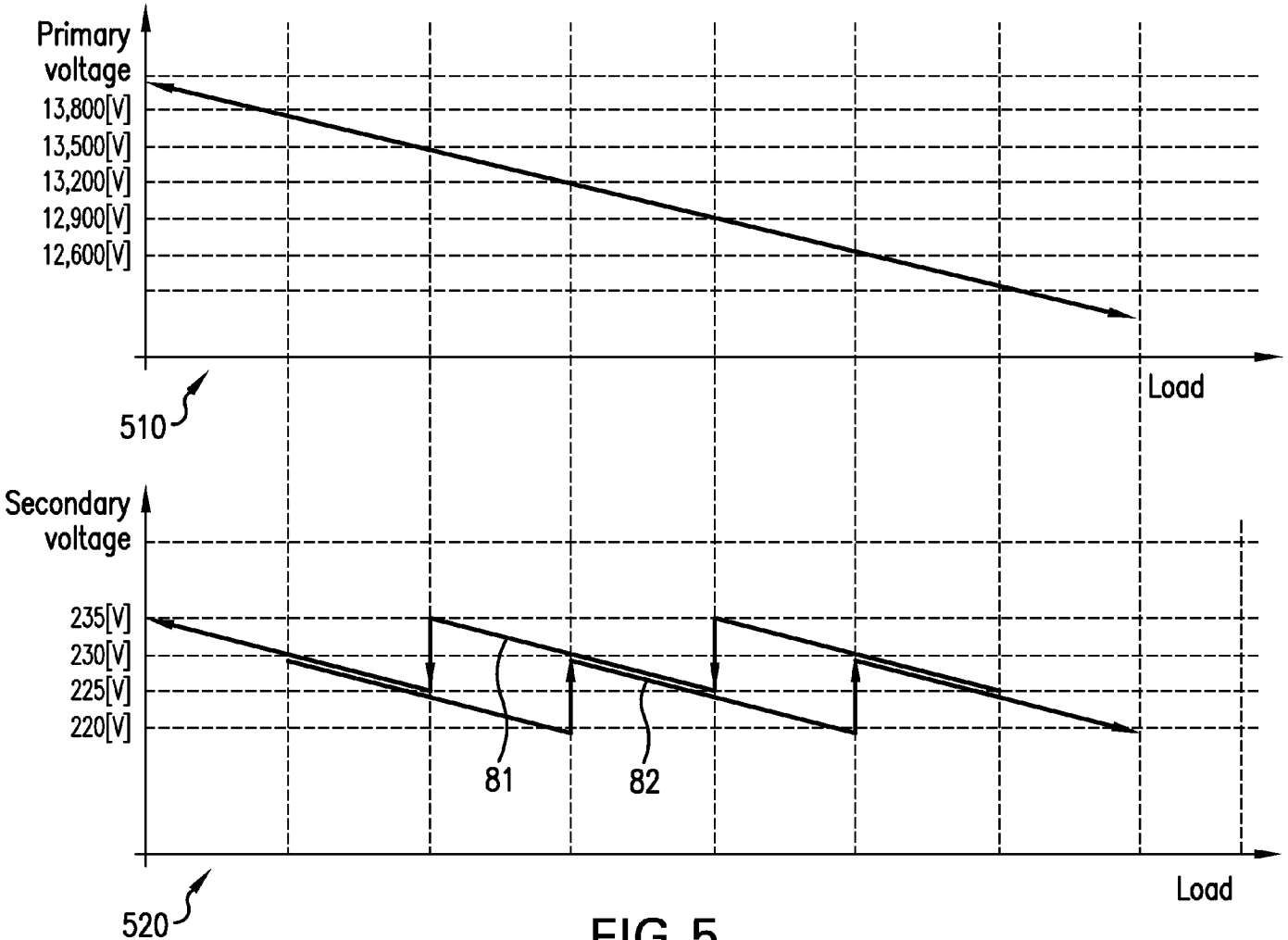
FIG. 5 is a graph for explaining a transformer power regulation method.

FIG. 5 is a graph for explaining a transformer power regulation method. In FIG. 5, a graph 510 depicts a voltage drop at a primary winding of a transformer with a load increasing, and a graph 520 depicts a voltage drop at a secondary winding of a transformer with a load increasing. In the graph 520, line diagrams 81 and 82 illustrate that voltage decreases and increases as a load of a distribution line increases and decreases.

Referring to the graph 510, voltage drops on a high-voltage line due to line resistance or power consumption sources from the transformer substation to each transformer. In addition, voltage drops on a low-voltage line due to line resistance or power consumption sources from the transformer to the load. Accordingly, as shown in the graph 520, the secondary winding of the transformer needs to compensate the voltage by adjusting the turn ratio of the transformer to control the voltage setup range. Conventionally, the turn ratio of the transformer is adjusted by controlling a tap for turn-ratio adjustment, which is installed at the transformer, to adjust the voltage at the secondary winding of the transformer. However, since the voltage across the load varies depending on hours, days, or seasons, it is very difficult to manually control the turn ratio of the transformer. Accordingly, it is necessary to automatically control the turn ratio of the transformer in real time.

In order to stably supply power to the power consumption source, voltage drops in the low-voltage line and service line should not exceed 4% and 2%, respectively. Accordingly, theoretically, in the case of a heavy load imposed on the transformer, the voltage drop in the secondary winding needs to be within 3V and the voltage drop between the secondary winding and the power consumption source needs to be within 13V.

Therefore, the secondary winding voltage should not exceed 236V, which is equal to the sum of the upper limit 233V and the voltage drop of 3V, and the voltage at the power consumption source should be more than 220V including the voltage drop of 13V.

Accordingly, the lower limit of a reference voltage of 220V is 207V considering a voltage variation of 6%. In this case, when further considering voltage drops in the transformer, the power consumption source, and the high-voltage line, the lower limit of the secondary winding of the transformer is about 220V.

Additionally, the upper limit of the reference voltage of 220V is 233V considering a voltage variation of 6%. In this case, when further considering voltage drops in the transformer and the high-voltage line, the upper limit of the secondary winding of the transformer is about 236V. Accordingly, in order to maintain the voltage between the lower limit 220V and the upper limit 235V, the secondary winding voltage of the pole transformer needs to be set in a range between 220V and 235V considering the voltage drop in the secondary winding.

In order to automatically adjust the secondary winding voltage within a range between 220V and 235V, the following voltage adjustment method may be used. The method is described in detail with reference to FIG. 2*c*.

When the transformer first operates at a primary winding voltage of 13,800V and then keeps operating at a primary winding voltage of 13,200V or less for more than 120 minutes due to an increased load, the control unit 130 detects it and operates the path-selection switch 111, current-circulation switch 112, bypass switch 113, and current circulation unit 120 for multiple switches to change the primary winding voltage to 13,200V according to the line diagram 82. At this time, the secondary winding voltage increases 10V to 230V.

Additionally, when the transformer first operates at a primary winding voltage of 13,200V and then keeps operating at a primary winding voltage of 12,600V or less for more than 120 minutes due to an increased load, the control unit 130 detects it and operates the path-selection switch 111, current-circulation switch 112, bypass switch 113, and current circulation unit 120 for multiple switches to change the primary winding voltage to 12,600V according to the line diagram 82. At this time, the secondary winding voltage increases 10V to 230V.

In addition, when the transformer first operates at a primary winding voltage of 12,600V or less and then keeps operating at a primary winding voltage more than 12,900V for more than 120 minutes due to a decreased load, the control unit 130 detects it and operates the path-selection switch 111, current-circulation switch 112, bypass switch 113, and current circulation unit 120 for multiple switches to change the primary winding voltage to an intermediate voltage between 12,600V and 13,200V according to the line diagram 81. At this time, the secondary winding voltage decreases 10V to 225V.

In addition, when the transformer first operates at a primary winding voltage of 13,200V or less and then keeps operating at a primary winding voltage more than 13,500V for more than 120 minutes due to a decreased load, the control unit 130 detects it and operates the path-selection switch 111, current-circulation switch 112, bypass switch 113, and current circulation unit 120 for multiple switches to change the primary winding voltage to the 13,800V point 43 according to the line diagram 81. At this time, the secondary winding voltage decreases 10V to 225V.

As described above, the transformer changes the voltage without power interruption with the current circulation unit 120 for multiple switches.

As described above, when the transformer keeps operating at a lowered primary winding voltage for a predetermined interval, the primary winding of the transformer is changed to boost the voltage. Additionally, when the transformer keeps operating at an increased primary winding voltage for a predetermined interval, the primary winding of the transformer is changed to decrease the voltage. Therefore, the secondary winding voltage of the transformer is maintained in a range between 220V and 235V, thereby stably supplying power to the power consumption source.

As apparent from the above description, since a switching device equipped with an uninterruptible power supply function changes a primary winding of a transformer without power interruption, consumers can be supplied with power without power interruption at a secondary winding of the transformer.

Additionally, even if a secondary winding voltage of the transformer is too high or low, it is possible to stably set the secondary winding voltage by automatically changing the primary winding voltage of the transformer.

Additionally, a turn ratio of a transformer can be efficiently adjusted using the switching device having an uninterruptible power supply function, thereby preventing a flicker.

Furthermore, a method of adjusting voltage of a transformer allows a transformer installed at each segment of a distribution line to reliably supply power to power consumption sources by setting voltage from a secondary winding of the transformer to a predetermined range.

Although the present invention is described with reference to example embodiments and the accompanying drawings, it is not limited to the example embodiments and the drawings. It should be understood that various modifications and changes can be made by those skilled in the art without departing from the spirit and scope of the present invention.

What is claimed is:

1. A switching device having an uninterruptible power supply function, comprising:

a plurality of switches operable by an external signal;

a current circulation unit for multiple switches electrically connected to a large-current path of the switches configured to perform a switch-on function in place of the switches upon switching on and off between the switches; and a control unit electrically connected to the switches and current circulation unit configured to read voltage values and to apply signals to the switches depending on the voltage values to sequentially switch the switches.

2. The switching device according to claim 1, wherein the control unit includes:

a detection circuit;

an A/D converter configured to convert voltage measured by the detection circuit into digital signals;

a sorting circuit configured to sort the digital signals by a predetermined range; and a switching control circuit configured to selectively output signals to the switches depending on the digital signals sorted by the sorting circuit.

3. The switching device according to claim 1, wherein the current circulation unit for multiple switches includes:

a first bypass part including a first capacitor and a first coil connected in parallel with each other;

a second bypass part electrically connected to one point where the first bypass part is connected in parallel with the first coil, and including a second capacitor and a second coil connected in parallel with each other; and an iron core arranged between the first and second coils and wound with the first and second coils.

4. The switching device according to claim 1, wherein the switches include:

a path-selection switch which connects a large-current path;

a current-circulation switch electrically connected to the large-current path; and a bypass switch electrically connected to the path-selection switch and electrically connected to a ground.

5. The switching device according to claim 1, wherein each of the switches includes at least one of (a) an insulated-gate bipolar transistor and (b) a silicon-controlled rectifier, and is switchable on and off by the control unit.

6. The switching device according to claim 1, wherein the switches, the current circulation unit for multiple switches, and the control unit are electrically connected through external connection terminals, and are enclosed by an insulator with the external connection terminals exposed.

7. A switching device, comprising:

a motor driven by a control signal;

a plurality of rotary switches sequentially coupled to a rotatable shaft of the motor and including a plurality of contact points;

a current circulation unit for multiple switches electrically connected to the contact points of the rotary switch configured to circulate current between the contact points connected by the rotary switch when the contact points of the rotary switch are changed by rotation of the rotary switch; and a control unit electrically connected to the motor configured to read a voltage value and to change the contact points of the rotary switch by rotating the motor depending on the voltage value.

8. The switching device according to claim 7, wherein the current circulation unit for multiple switches includes:

a first bypass part including a first capacitor and a first coil connected in parallel with each other;

a second bypass part electrically connected to one point where the first bypass part is connected in parallel with the first coil, and including a second capacitor and a second coil connected in parallel with each other; and an iron core arranged between the first and second coils and wound with the first and second coils.

9. The switching device according to claim 7, wherein the control unit includes:

a detection circuit;

an A/D converter configured to convert voltage measured by the detection circuit into digital signals;

a sorting circuit configured to sort the digital signals by a predetermined range; and a motor drive circuit configured to output signals for rotating the motor depending on the digital signals sorted by the sorting circuit.

* * * * *